US009087414B2

(12) United States Patent
Vienneau et al.

(10) Patent No.: US 9,087,414 B2
(45) Date of Patent: Jul. 21, 2015

(54) PAPER ROLL HOLDER AND TICKET BEZEL FOR A TICKET PRINTER

(75) Inventors: Daniel Vienneau, Dieppe (CA); Denis Daigle, Dieppe (CA); Talina Bourgeois, Dieppe (CA)

(73) Assignee: NANOPTIX INC., Dieppe (CA)

( * ) Notice: Subject to any disclaimer, the term of this patent is extended or adjusted under 35 U.S.C. 154(b) by 821 days.

(21) Appl. No.: 13/229,430

(22) Filed: Sep. 9, 2011

(65) Prior Publication Data

US 2012/0085857 A1 Apr. 12, 2012

Related U.S. Application Data

(60) Provisional application No. 61/381,834, filed on Sep. 10, 2010.

(51) Int. Cl.
*B65H 16/06* (2006.01)
*G07B 7/00* (2006.01)

(52) U.S. Cl.
CPC ..... *G07B 7/00* (2013.01)

(58) Field of Classification Search
CPC ..... A47K 10/40; B41J 11/00; B41J 15/02; B41J 15/04; B41J 15/042; B65H 16/06; B65H 19/126; B65H 2801/12; B65H 2301/41369
USPC ..... 242/596, 596.7, 597, 597.2, 597.5, 242/597.6, 599, 599.4, 577, 577.3, 578, 242/578.3
See application file for complete search history.

(56) References Cited

U.S. PATENT DOCUMENTS

| | | | | |
|---|---|---|---|---|
| 3,878,998 | A * | 4/1975 | Lazzari | 242/596.4 |
| 8,500,058 | B2 * | 8/2013 | Lan | 242/578 |
| 8,845,089 | B2 * | 9/2014 | Akatsu et al. | 242/596 |
| 2001/0054667 | A1 * | 12/2001 | Komatsu et al. | 242/596.1 |
| 2013/0271543 | A1 * | 10/2013 | Akatsu et al. | 242/596 |

* cited by examiner

*Primary Examiner* — William A Rivera
(74) *Attorney, Agent, or Firm* — Sughrue Mion, PLLC

(57) ABSTRACT

The present invention discloses a spindle assembly for a ticket printer which permits the paper roll to be changed without removing the spindle assembly from the ticket printer. The spindle assembly consists of two arms mounted on the printer, on the upper portion of each respective arm is mounted a backing plate from which a spindle protrudes. The spindle may be retracted for loading paper by rotating a spindle actuator which is elevated by two ramps mounted thereon. The elevation of the actuator, which is connected to the spindle, retracts the spindle from the backing plate. An anti-theft ticket bezel is also disclosed, which has teeth incorporated into the ceiling within the opening of the bezel, so that if a ticket is pulled from outside the teeth tear the ticket or cuts it into strips, rendering the ticket useless.

5 Claims, 7 Drawing Sheets

PAPER ROLL HOLDER AND TICKET BEZEL FOR A TICKET PRINTER

FIELD OF THE INVENTION

The invention relates generally to printers for gaming tickets and specifically to a paper roll holder and ticket bezel for a gaming ticket printer.

BACKGROUND OF THE INVENTION

A typical paper roll holder for holding the roll of ticket blanks for gaming ticket printers is difficult to refill, since it needs to be accessed from the side in order to replace the paper roll. This requires clearance for access which limits the proximity between two gaming machines, thereby consuming valuable floor space in a casino, or requires the machines to be designed so as to have greater clearance, forcing the use of a larger cabinet for the gaming machine.

U.S. Pat. No. 4,192,618 discloses a high-speed ticket printer which has a spindle mounted in the back so that the printer must be removed from the device in which it is held in order to replace the paper on the spindle. U.S. Patent Application Publication No. 2004/0056086 discloses a paper jam detection apparatus that uses a paper spindle, and this spindle must be removed from the machine in order to replace the paper thereon.

Printers for secure documents such as gaming ticket printers are targets for theft of ticket blanks, which unscrupulous operators then attempt to print into a ticket which can be cashed out for value. While the gaming machines themselves are physically secure, in the past the tickets may be stolen by pulling on the ticket stub as it is printing out, thereby receiving several ticket blanks instead of the one ticket that they are intended to receive.

U.S. Patent Application Publication No. 2004/0048648 discloses a universal printer bezel on a gaming machine. U.S. Pat. No. 7,275,483 discloses a jam-resistance printer bezel for gaming machines. U.S. Pat. No. 4,367,666 discloses a stock feed and shear system for cutting tickets in an automatic ticket vending machine. However, none of these patents disclose anti-theft features to prevent the theft of ticket blanks Therefore there is a need for a paper roll holder for a ticket printer which allows paper to be loaded without removal of the spindle from the machine and without requiring side clearance, as well as for a paper bezel that is capable of preventing the theft of ticket blanks

SUMMARY OF THE INVENTION

The present invention discloses a paper roll holder for holding a paper roll for a printer, the paper roll holder comprising a first and a second spindle assembly, each spindle assembly comprising an arm comprising a lower arm and an upper arm, the lower arm being mounted to a printer and the upper arm having a hole in its center; a disk-like backing plate having a hole in its center mounted to the upper arm; a disk-like spindle actuator biased by a spring and mounted opposite the backing plate on the upper arm, the actuator having two circular faces, a first face facing the upper arm, said face having two protruding ramps, which ramps are diametrically opposed to each other in position and semi-circumferentially mounted; a cylindrical spindle mounted to said actuator, passing through the hole in the upper arm and through the hole in the backing plate so as to protrude from the backing plate, wherein the actuator is rotatable such that each of the two ramps interposes itself between the upper arm, thereby retracting said spindle, and wherein the first and second spindle assembly are mounted such that the respective spindles face each other. The present invention also discloses a ticket bezel for a printer, the bezel comprising a frame defining an opening which opening is a paper path, and which opening has a ceiling; and a plurality of teeth comprising pyramidal forms mounted on the ceiling of said opening, adapted to tear paper passing through the opening when the paper is pulled.

BRIEF DESCRIPTION OF THE DRAWINGS

It will now be convenient to describe the invention with particular reference to one embodiment of the present invention. It will be appreciated that the diagrams relate to one embodiment of the present invention only and are not to be taken as limiting the invention.

DETAILED DESCRIPTION OF THE DRAWINGS

The present invention will now be described more fully hereinafter with reference to the accompanying drawings, in which preferred and other embodiments of the invention are shown. No embodiment described below limits any claimed invention and any claimed invention may cover processes or apparatuses that are not described below. The claimed inventions are not limited to apparatuses or processes having all the features of any one apparatus or process described below or to features common to multiple or all of the apparatuses described below. It is possible that an apparatus or process described below is not an embodiment of any claimed invention. The applicants, inventors or owners reserve all rights that they may have in any invention claimed in this document, for example the right to claim such an invention in a continuing application and do not intend to abandon, disclaim or dedicate to the public any such invention by its disclosure in this document.

Figure 1B:
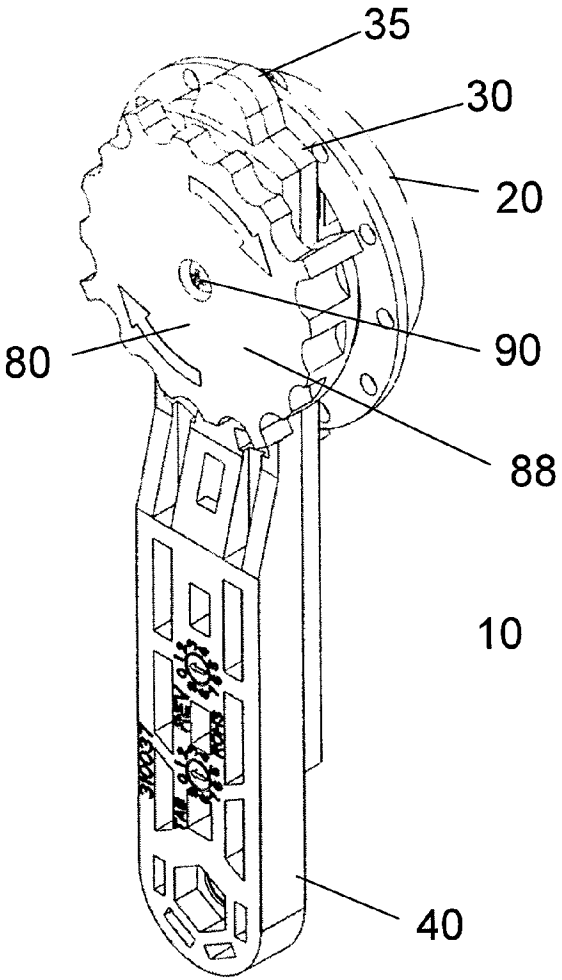
FIG. 1B is a perspective view of the back of a spindle assembly, according to one embodiment of the present invention.
Figure 1A:
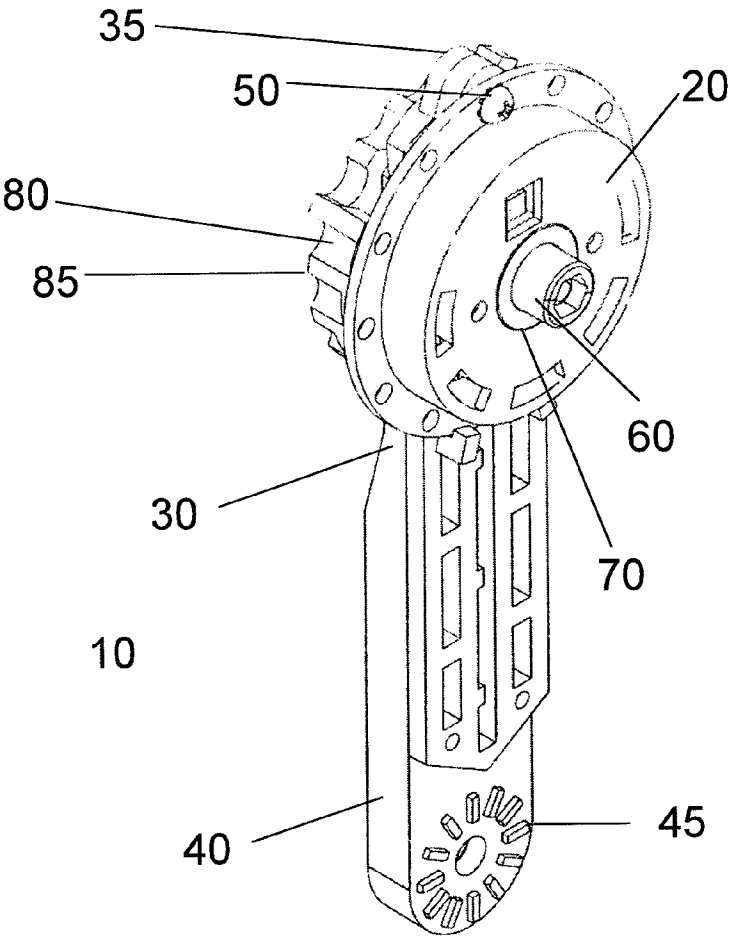
FIG. 1A is a perspective view of the front of a spindle assembly, according to one embodiment of the present invention.
Figure 4:
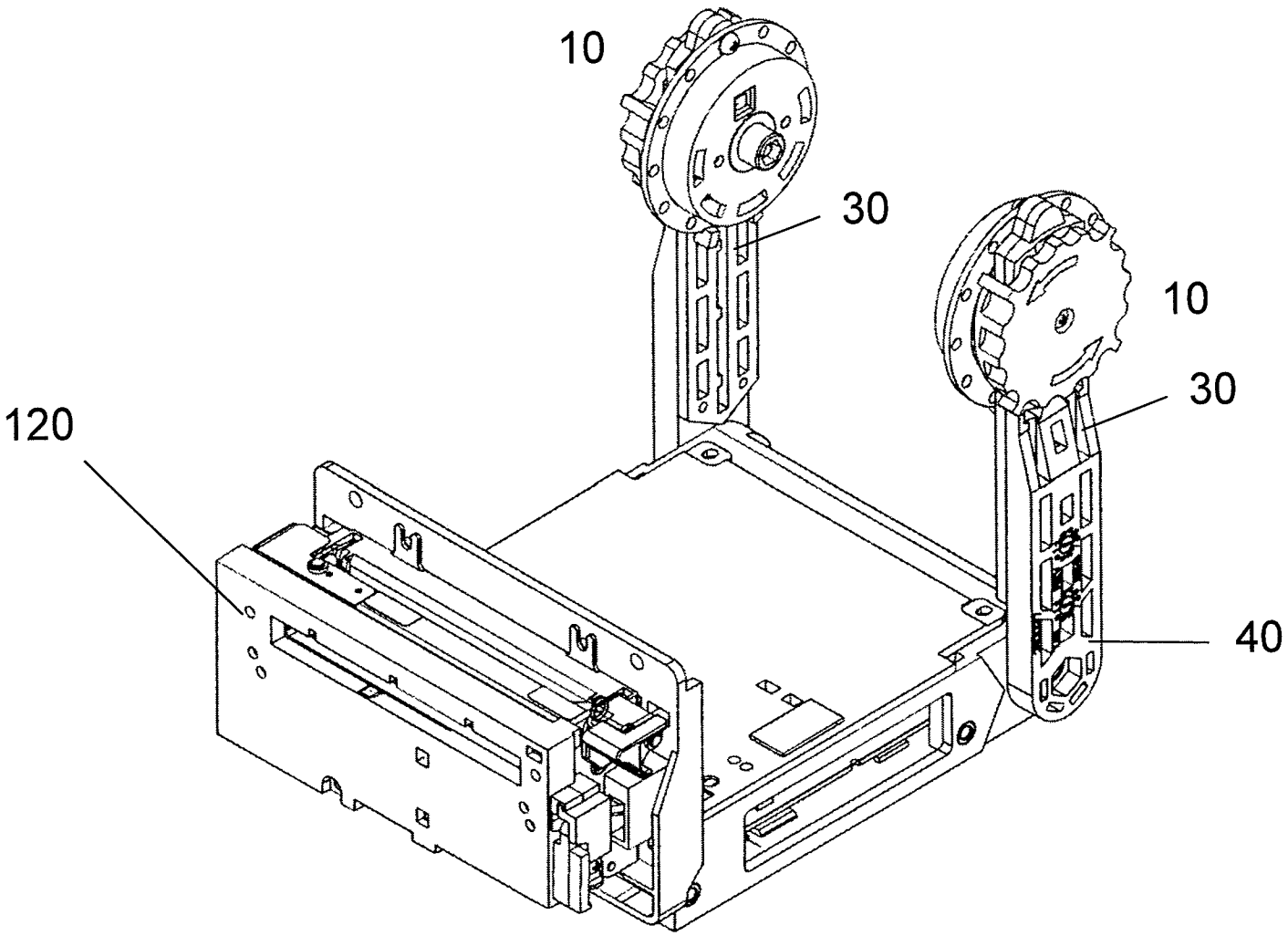
FIG. 4 is a perspective view of the paper roll holder mounted on a ticket printer, according to one embodiment of the present invention.

With reference to FIG. 4, the paper roll holder, made up of two opposing spindle assemblies 10, is shown mounted to the printer 120. With reference to FIGS. 1A, 1B, and according to one embodiment of the present invention, the front and back of the spindle assembly 10 is shown, which is representative of one of the two spindle assemblies required to form the paper roll holder. The spindle assemblies 10 are mounted on the printer 120 by means of arms, each arm with an upper arm 30 having a hole (not shown) therein, and lower arm 40, which is mounted to the printer 120. A disk-like backing plate 20 is mounted on the upper arm 30 by fastening means 50 such as a screw passing through a mount 35 positioned on the upper arm 30. The backing plate 20 is circular with a hole 25 in its center permitting the front of the spindle 60 to protrude through the centre of the backing plate 20. In one embodiment the cylindrical spindle 60 is mounted within a spindle sleeve 70, which sleeve passes through the hole (not shown) in the upper arm 30 and the hole 25 in the backing plate 20 so as to be flush with the backing plate 20. The spindle 60 protrudes from the backing plate 20 a certain distance 65, which distance is an amount sufficient to hold one side of a roll of paper. Rotatably mounted to the opposite side of the upper arm 30 is a circular spindle actuator 80, which is fastened into the rear of the spindle 60 by fastening means 90 such as a screw. The screw may pass through the spindle 60 and be fastened by means of a bolt 95 (shown in FIG. 2) at the front of the spindle 60. The spindle 60 is a cylindrical support for the paper roll (not shown), which protrudes from the backing plate 20 at one end, and is affixed to the disk-like spindle actuator 80 at the other. One skilled in the art would appreciate that the spindle 60 may be molded as one piece with the actuator 80, obviating the need for a fastening means.

Figure 2:
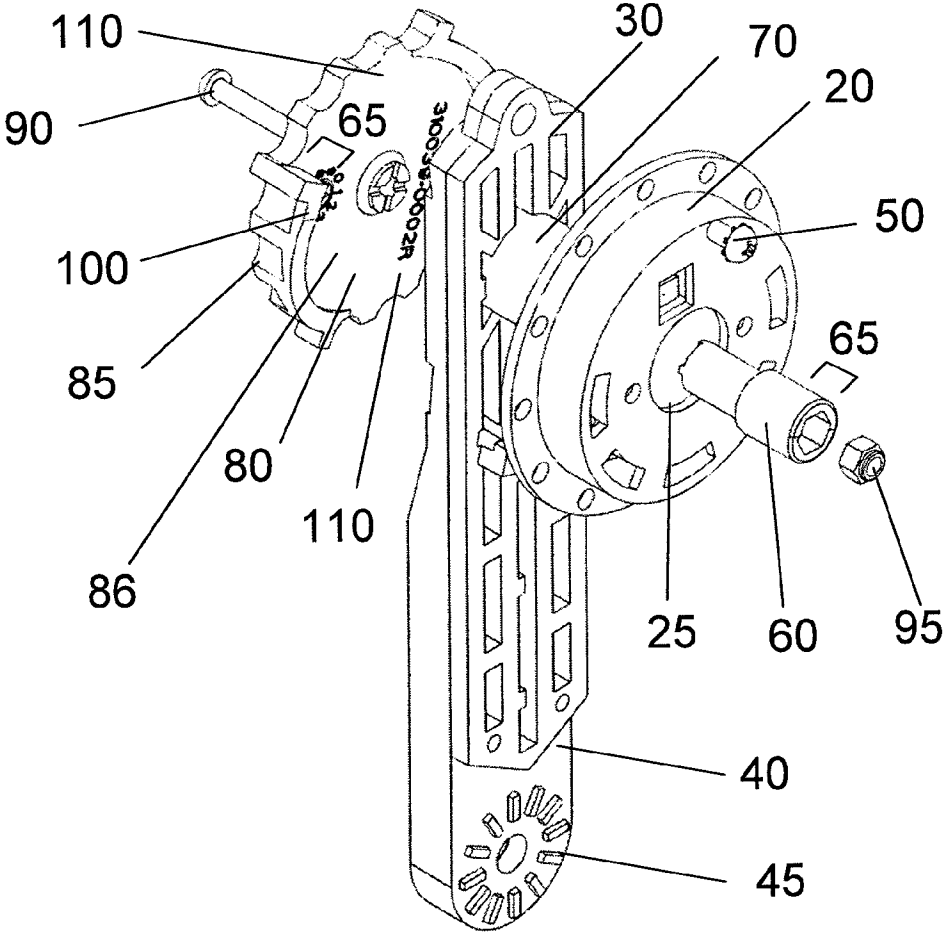
FIG. 2 is a perspective view of a disassembled spindle assembly, according to one embodiment of the present invention.
Figure 3:
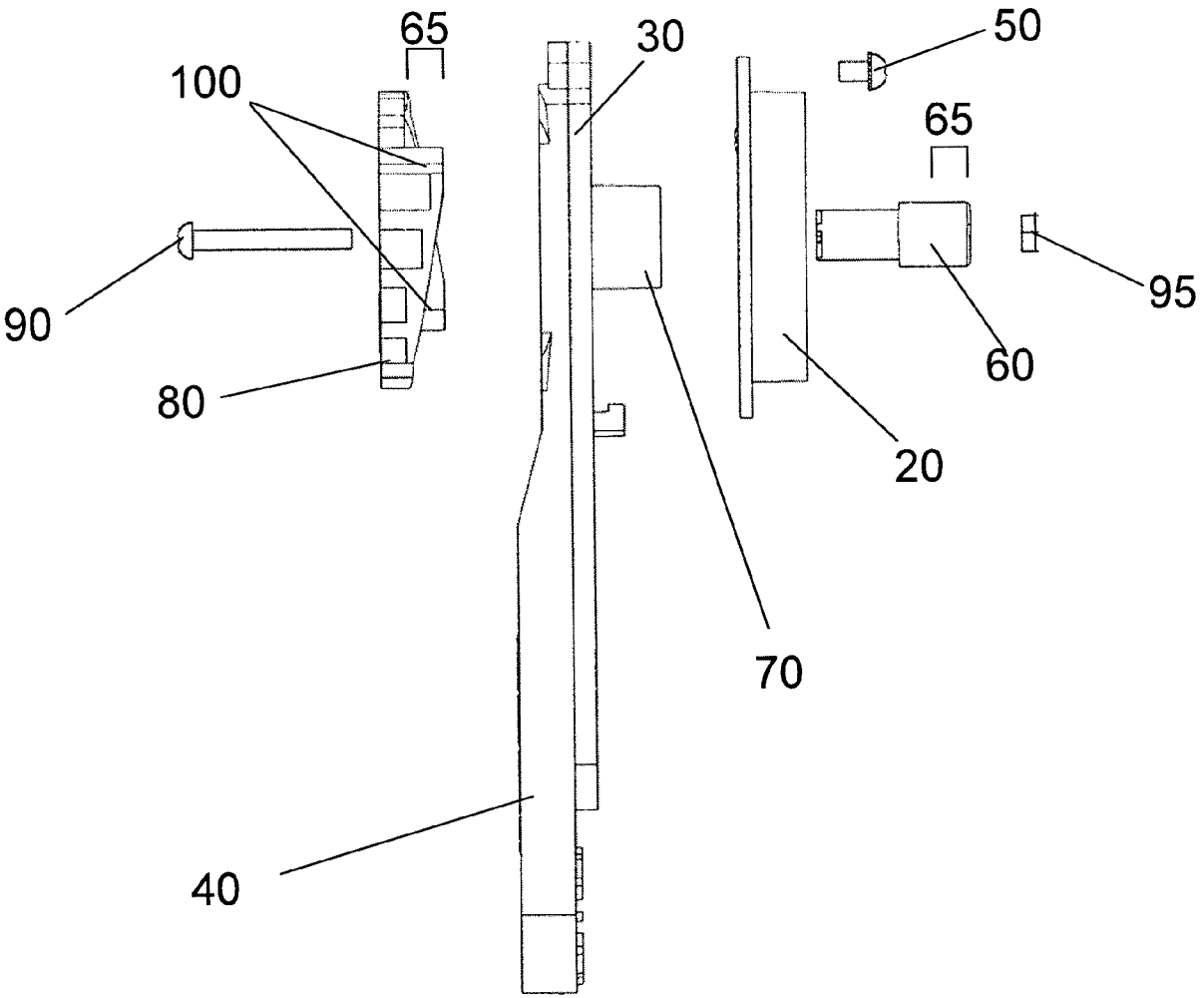
FIG. 3 is a side view of a disassembled spindle assembly, according to one embodiment of the present invention.

With reference to FIGS. 2 and 3, the spindle assembly is shown partially disassembled. The spindle is mounted within a spindle sleeve 70 which is molded onto the upper arm 30 and stabilizes the spindle 60. The spindle 60 is biased by a spring in a frontward direction, so that the spring (not shown) urges the spindle 60 to protrude out of the backing plate 20 a certain distance 65. The spindle actuator 80 is disk-shaped with a scalloped edge 85 and has two faces, a first face 86 facing the upper arm 30, and a second face 88 facing away from the upper arm 30. The first face 86 has two semi-circumferentially-mounted ramps 100 protruding out of the first face 86 towards the upper arm 30. The position of each ramp 100 is diametrically opposed across the first face 86 with respect to the other. Each ramp 100 elevates progressively over approximately ¼ of the circumference so as to protrude a certain distance 65 at its maximum elevation. The two lands 110 of approximately ¼ of the circumference having no ramp are flat, and are wide enough to accommodate the width of the upper arm 30.

With reference to FIGS. 1 and 4, the lower arm 40 is adapted to be fixedly mounted to a printer, with molded flanges 45 preventing the unintentional rotation of the upper and lower arms 30, 40 relative to the printer 120 on which it is mounted. Once matching spindle assemblies are affixed to the printer 120 opposite one another, a roll of paper may be placed therebetween in order to feed paper into the printer 120.

With reference to FIGS. 2 and 4, operation of the spindle assembly 10 will now be described. One spindle assembly is mounted at each side of the printer, and each oriented so as to face the other. This permits each to have a protruding spindle 60 facing the other. The spindle assembly 10 may be placed into two positions: normal operating position and paper loading position. Normal operating position is where both spindles 60 are protruding as a result of the biasing of a spring (not shown), and a roll of paper (not shown) mounted on the spindles between the back plates 20 of the respective spindle assemblies 10. In this position, the printer 120 will draw paper from the roll (not shown) on the spindle, in order to print gaming tickets (not shown). In the paper loading position, the spindle actuator 80 is turned by its scalloped edge 85, which provides grip for an operator's hand. As the spindle actuator is turned, the ramps are interposed between the spindle actuator 80 and the upper arm 30, such that the spindle actuator is pushed away from the upper arm 30. Since the rear of the spindle is affixed to the spindle actuator 80, the spindle 60 is pulled back as the actuator 80 moves. The ramp 100 has an elevation corresponding to the certain distance 65 of the protrusion of the spindle 60, so that when the maximum elevation of the ramp 100 is interposed between the actuator 80 and upper arm 30 the spindle 60 retracts and is flush with the back plate 20. This is the paper loading position. With both facing spindle assemblies in the paper loading position, the spindles 60 are retracted within the back plates 20 and the paper roll (not shown) may be replaced.

In the normal operating position, the actuator 80 is released, and the force of the biasing spring (not shown) returns the actuator 80 to a position wherein the upper arm 30 slides off the ramps 100 and is finally positioned against lands 110, and the spindle 60 projects a certain distance 65 from the back plate 20. The actuators 80 of the two facing spindle assemblies 10 are released once the roll (not shown) is positioned within the spindle assemblies. In this manner, the spindles protrude and hold the center of the paper roll, while permitting said roll to turn.

A person skilled in the art would appreciate that the parts for the spindle assembly could most effectively be made from molded plastic, with the exception of the fastening means and biasing spring, which are preferably made from metal. The spindle may be made from metal for durability, or another material, and other parts may indeed be manufactured from metal or other materials depending on the required durability, without departing from the scope of the invention.

Figures 5A, 5B:
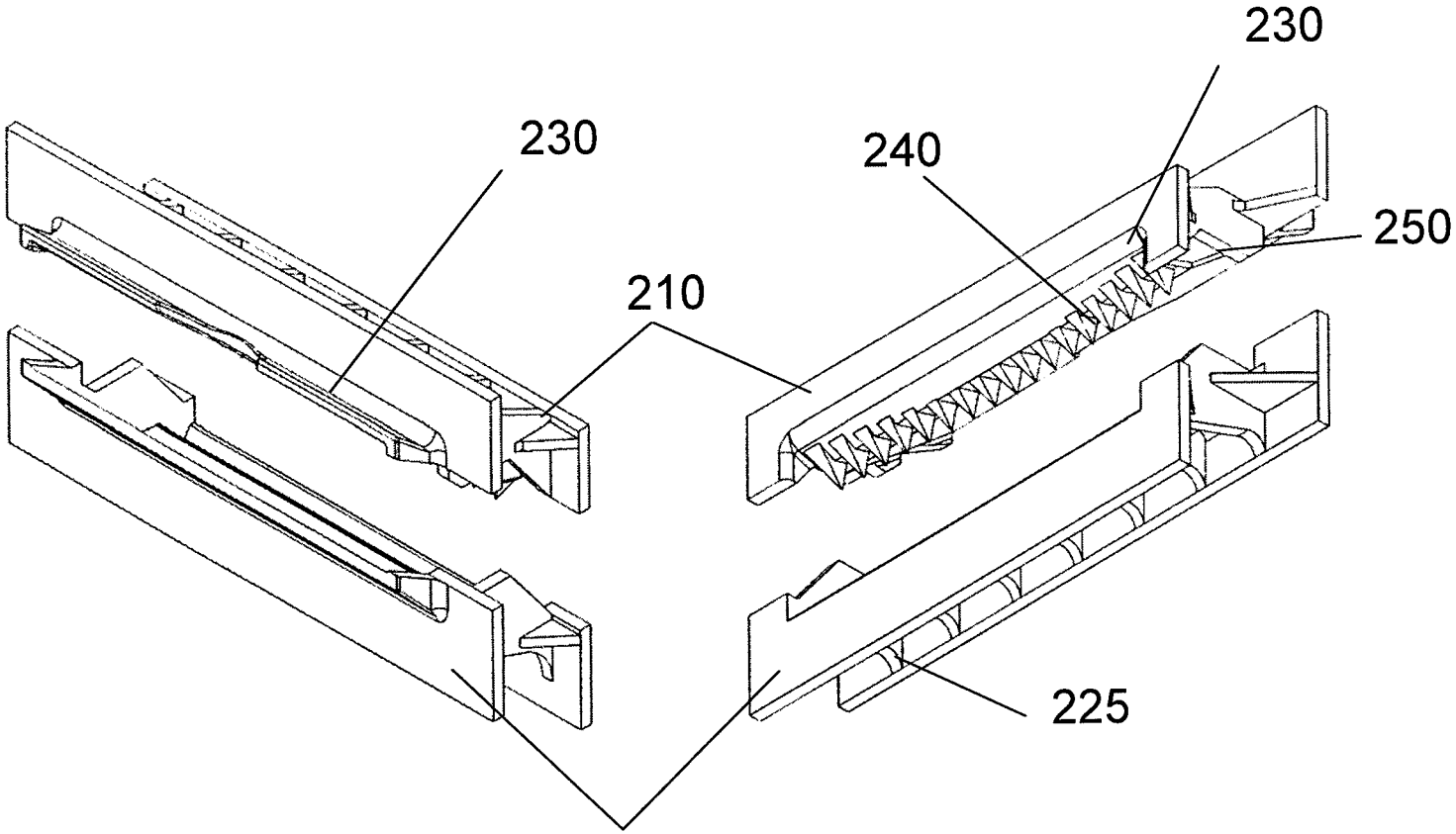
FIG. 5A is a top perspective view of a disassembled ticket bezel, according to another embodiment of the present invention.
FIG. 5B is a bottom perspective view of a disassembled ticket bezel, according to another embodiment of the present invention.

With reference to FIGS. 5A and 5B showing the ticket bezel disassembled into two pieces, FIG. 5A shows the ticket bezel from above and FIG. 5B shows the ticket bezel from below. The bezel has an upper and lower frame 210, 220 which is molded from plastic, and fits within the game machine. The upper and lower frames 210, 220 have reinforcement tabs molded into their walls to add rigidity without using unnecessary plastic. The upper and lower frames 210, 220 fit together so as to produce the bezel. One skilled in the art would know that the bezel may be molded in one piece instead. The bezel has a protruding lip 230 which guides the paper out of the machine and allows the player to remove the paper easily once it is presented. The teeth 240 comprising sharp pyramidal forms, are mounted on the ceiling 250 of the opening 260 (shown in FIG. 6) of the bezel behind the lip. The opening 260 is a paper path created by the junction of the upper and lower frames 210, 220, for the paper to pass from the interior of the machine to the exterior of the machine.

Figure 6:
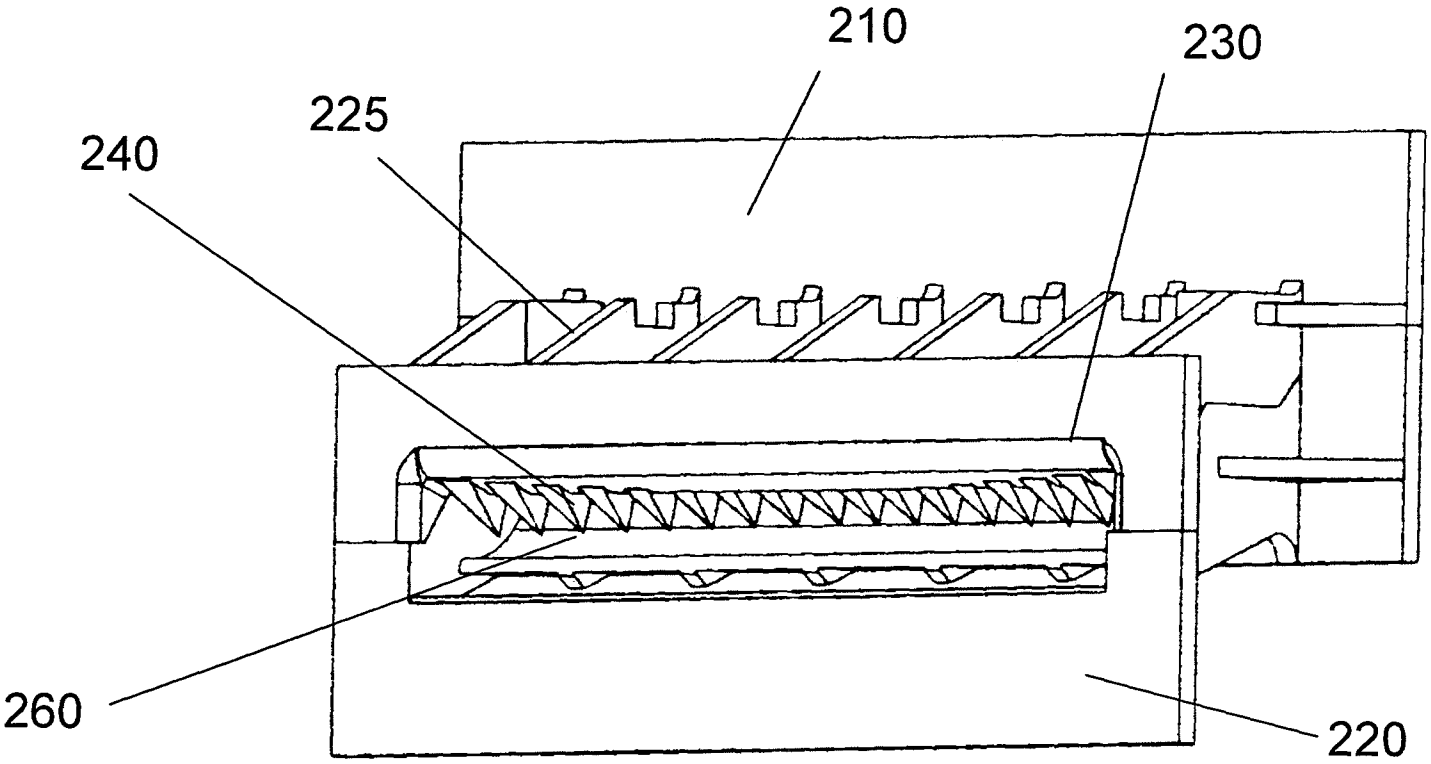
FIG. 6 is perspective view of the assembled ticket bezel, according to another embodiment of the present invention.
Figure 7:
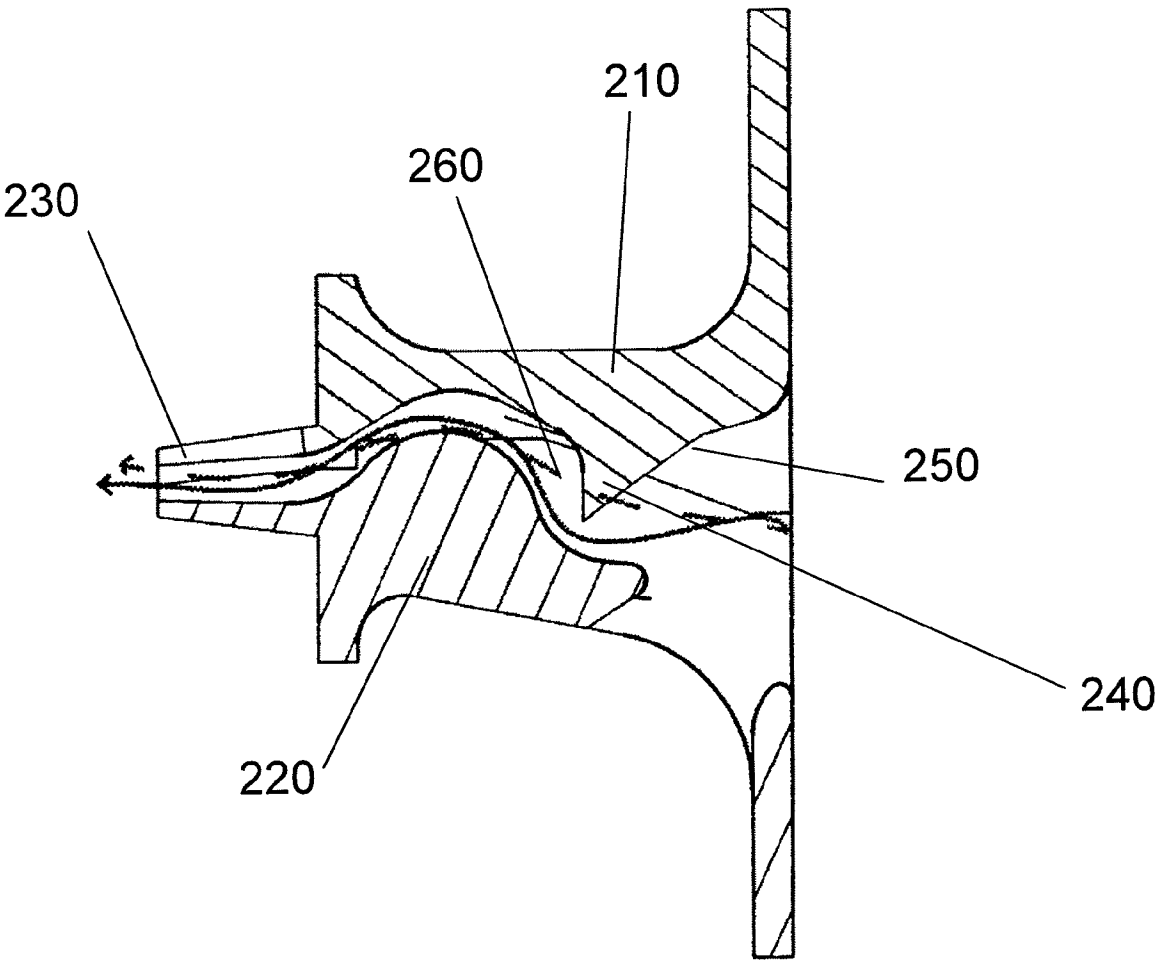
FIG. 7 is a cross-sectional view of the ticket bezel, according to another embodiment of the present invention.

With reference to FIG. 6 the bezel is shown assembled, with the upper and lower frames 210, 220 affixed together, the teeth 240 located within and at the top of the opening 260. In FIG. 7, the paper path of the bezel is shown by the arrow, passing the assembled bezel. Under normal operation, the solid line shows how the paper passes through the bezel and does not contact the teeth 240. However, should the paper be pulled on by the player in order to attempt to retrieve ticket blanks, the stippled line shows how the teeth 240 will cut the paper into strips as a result of their impact on the paper (not shown). Once the paper is cut into strips, it is no longer useful as a ticket blank, thereby frustrating any theft attempt. In another embodiment, the teeth 240 tear the paper across its width as a result of contact with the paper. Once the paper is torn, it is no longer useful and no more can be pulled from the printer 120.

With reference to FIG. 7, the paper path is shown through the bezel. The solid line indicates the normal paper path, while the dashed line shows the paper path when the paper is pulled from the outside of the machine by a player. The dashed line impacts the teeth 240 so as to tear the paper as described above.

A person skilled in the art would appreciate that the parts for the bezel would most effectively be made from molded plastic, however other materials such as metal or glass could be used without departing from the scope of the invention.

Many modifications and other embodiments of the invention will come to the mind of a person skilled in the art having the benefit of the teachings presented in the foregoing description and associated drawings. Therefore, it is understood that the invention is not to be limited to the specific embodiment disclosed, and that modifications and embodiments are intended to be included within the scope of the appended claims.

The invention claimed is:

1. A paper roll holder for a printer, the paper roll holder comprising:

i) a first and a second spindle assembly, each spindle assembly comprising:

(a) an arm comprising a lower arm and an upper arm, the lower arm being mounted to a printer and the upper arm having a hole in its center;

(b) a disk-shaped backing plate having a hole in its center mounted to the upper arm;

(c) a disk-shaped spindle actuator biased by a spring and mounted opposite the backing plate on the upper arm, the actuator having a first face facing the upper arm, said face having two protruding ramps, the ramps diametrically opposed to each other in position and semi-circumferentially mounted;

(d) a cylindrical spindle mounted to said actuator, the spindle passing through the hole in the upper arm and through the hole in the backing plate so as to protrude from the backing plate wherein the actuator is rotatable such that each of the two ramps interposes itself between the upper arm, thereby retracting said spindle, and wherein the first and second spindle assembly are mounted opposite to one another such that the respective spindles face each other to receive a paper roll.

2. The paper roll holder of claim 1 further comprising a spindle sleeve molded onto the upper arm for stabilizing the spindle.

3. The paper roll holder of claim 1 wherein the spindle actuator has a scalloped edge.

4. The paper roll holder of claim 1 wherein the lower arm has molded flanges.

5. The paper roll holder of claim 1 wherein each spindle assembly may be positioned in a normal operating position, wherein the spindle protrudes as a result of the biasing of the spring, or a paper loading position, wherein the spindle is pulled back into the back plate.

* * * * *